US006805101B2

(12) United States Patent
Magel

(10) Patent No.: US 6,805,101 B2
(45) Date of Patent: Oct. 19, 2004

(54) FUEL INJECTION DEVICE

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,074

(22) PCT Filed: Apr. 27, 2002

(86) PCT No.: PCT/DE02/01551

§ 371 (c)(1),
(2), (4) Date: Sep. 5, 2003

(87) PCT Pub. No.: WO02/092997

PCT Pub. Date: Nov. 21, 2002

(65) Prior Publication Data

US 2004/0035397 A1 Feb. 26, 2004

(30) Foreign Application Priority Data

May 17, 2001 (DE) ..... 101 23 910

(51) Int. Cl.[7] ..... F02M 37/04
(52) U.S. Cl. ..... 123/467; 123/446
(58) Field of Search ..... 123/446, 447, 123/467, 500, 501; 239/88–96

(56) References Cited

U.S. PATENT DOCUMENTS 4,069,800 A * 1/1978 Kanda et al. ..... 123/447
4,485,789 A * 12/1984 Walter et al. ..... 123/467
5,537,972 A * 7/1996 Beck et al. ..... 123/198 DB
6,227,166 B1 * 5/2001 Mack ..... 123/446
6,532,943 B1 * 3/2003 Yudanov ..... 123/502

FOREIGN PATENT DOCUMENTS

| | | |
|---|---|---|
| DE | 4311627 | * 10/1994 |
| DE | 199/0970 | * 9/2000 |
| DE | 19952512 | * 5/2001 |
| GB | 1565089 | * 4/1980 |

* cited by examiner

*Primary Examiner*—Carl S. Miller
(74) *Attorney, Agent, or Firm*—Ronald E. Greigg

(57) ABSTRACT

A fuel injection system for internal combustion engines includes an injector supplied from a high-pressure fuel source and a pressure booster device, in which the pressure booster device has a movable pressure booster piston that disconnects a chamber that is connectable to the high-pressure fuel source from a high-pressure chamber communicating with the fuel injector, and by filling a return chamber of the pressure booster device with fuel and by evacuating the return chamber of fuel, the fuel pressure in the high-pressure chamber can be varied, and the fuel injector has a movable closing piston, for opening and closing injection openings, which protrudes into a closing pressure chamber, so that the closing piston can be subjected to fuel pressure to attain a force acting in the closing direction on the closing piston, and the closing pressure chamber and the chamber are formed by a common work chamber, and all the portions of the work chamber communicate permanently with one another for exchanging fuel.

20 Claims, 8 Drawing Sheets

FUEL INJECTION DEVICE

CROSS-REFERENCE TO RELATED APPLICATIONS

This application is a 35 USC 371 application of PCT/DE 02/01551 filed on Apr. 27, 2002.

BACKGROUND OF THE INVENTION

1. Field of the Invention

The invention is directed to an improved fuel injection system for internal combustion engines, including a pressure booster between the fuel injector and a high pressure source.

2. Description of the Prior Art

From German Patent Disclosure DE 43 11 627, fuel injection systems are already known in which an integrated pressure booster piston, by means of filling or evacuating a return chamber, makes it possible to increase the fuel injection pressure above the value furnished by a common rail system.

SUMMARY OF THE INVENTION

The fuel injection system of the invention has the advantage over the prior art that because triggering is done exclusively via the return chamber of the pressure booster, the triggering losses in the high-pressure fuel system, by comparison with triggering via a work chamber communicating intermittently with the high-pressure fuel source, are less. Moreover, the high-pressure region, and in particular the high-pressure chamber, is relieved only down to rail pressure and not down to the leakage level, which improves the hydraulic efficiency.

By using a fast-switching piezoelectric valve as the control valve, small injection quantities can be injected into the combustion chamber of an internal combustion engine in a defined way and with small variations in quantity even when the nozzle opening pressure is high; moreover, because of the fast switching, only slight leakage losses occur.

A disposition of the pressure booster coaxially to the closing piston advantageously makes a small-volume, economical design possible.

A variation in the switching speed especially in a piezoelectric valve that has an essentially linearly triggerable piezoelectric actuator makes it possible to change the pressure increase gradient at the onset of injection, or in other words to shape the course of injection, and thus enables optimal adaptation of the course of injection to the requirements of the engine.

By using a fast-switching piezoelectric valve as the control valve, small injection quantities can be injected into the combustion chamber of an internal combustion engine in a defined way and with small variations in quantity even when the nozzle opening pressure is high; because of the fast switching, only slight leakage losses moreover occur.

A variation in the switching speed especially in a piezoelectric valve that has an essentially linearly triggerable piezoelectric actuator makes it possible to change the pressure increase gradient at the onset of injection, or in other words to shape the course of injection, and thus enables optimal adaptation of the course of injection to the requirements of the engine.

If a 3/3-port directional piezoelectric activated valve is used, then the intermediate position can be realized by a partial stroke of the piezoelectric actuator and used to create an injection at low pressure. This also makes a shaping of the course of injection possible and in particular a boot injection and improves the metering of small fuel quantities.

A further-improved needle closure is achieved by an optimized hydraulic adaptation, in particular of a filling path of the high-pressure chamber. To that end, an acceleration phase is generated, in which the pressure in the nozzle chamber is less than the pressure in the needle pressure chamber. The result is an additional hydraulic closing force on the nozzle needle, and the acceleration phase upon closure can be shortened sharply. Because of the faster needle closure, the characteristic quantity curves in ballistic operation become shallower. As a result of this hydraulic supplementary force, very stable needle closure and thus a very stable end of injection are achieved. This increases the metering accuracy of the injector. Moreover, a faster reaction of the nozzle needle to the control signal end is achieved, as a result of which a shallower characteristic quantity curve in the ballistic range is achieved, and the metering accuracy is enhanced still further. Simultaneously, because of the faster needle closure, an improvement in engine emissions can be expected.

BRIEF DESCRIPTION OF THE DRAWINGS

Exemplary embodiments of the invention are explained in further detail herein below, with reference to the drawings, in which.

DESCRIPTION OF THE PREFERRED EMBODIMENTS

Figure 1:
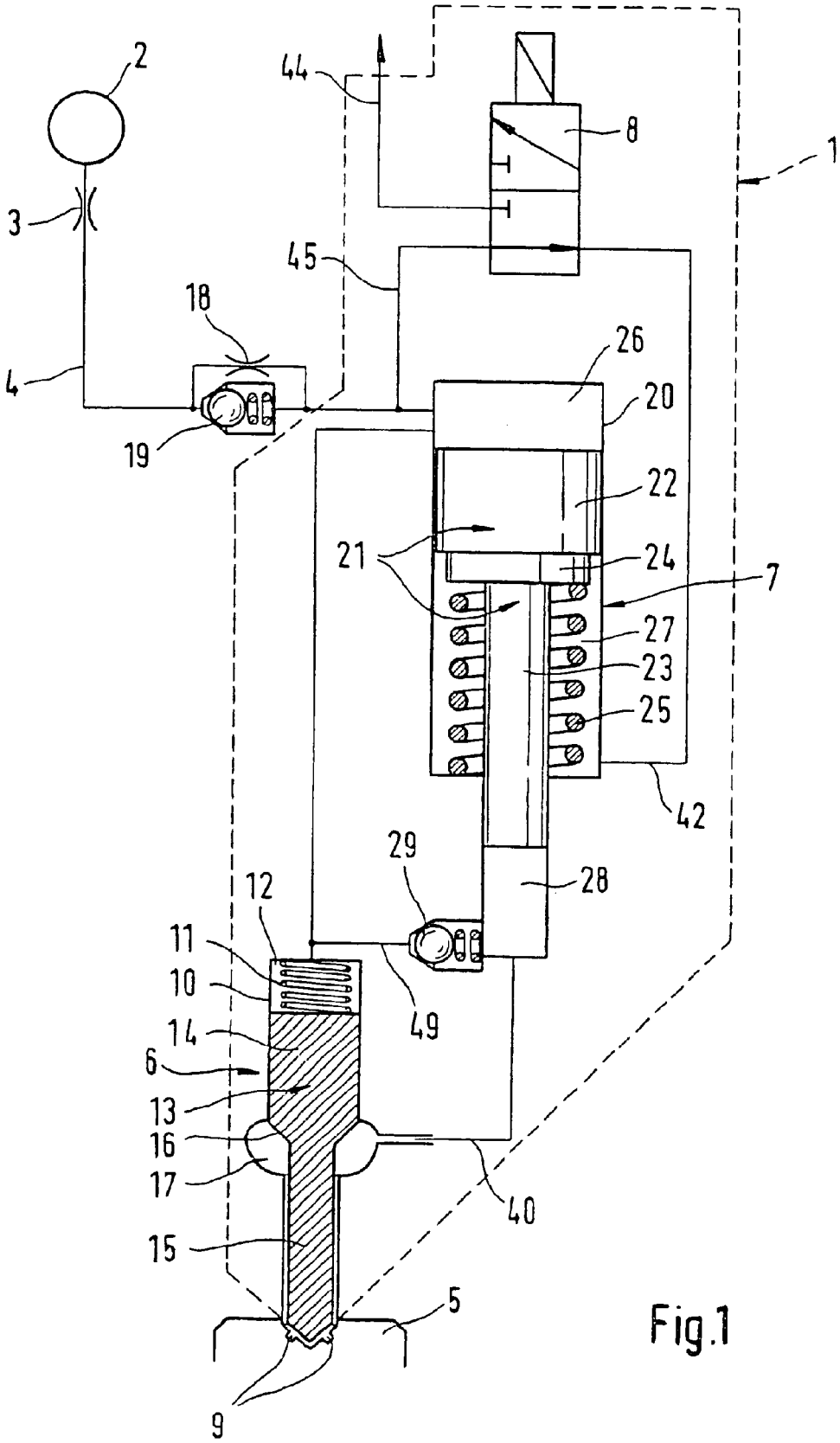
FIG. 1 shows a fuel injection system embodying the invention.

In FIG. 1, a fuel injection system is shown in which a fuel injector 1 that has a pressure booster device 7 communicates with a high-pressure fuel source 2 via a fuel line 4; in the line 4 there is a throttle 3 on the side toward the high-pressure fuel source, and a check valve 19 connected parallel to a second throttle 18 is disposed on the side toward the injector. The high-pressure fuel source includes a plurality of elements not shown in detail, such as a fuel tank, a pump, and the high-pressure rail of a common rail system known per se; the pump furnishes a fuel pressure of up to 1600 bar to the high-pressure rail by pumping fuel from the tank into the high-pressure rail. A separate injector supplied from the high-pressure rail is provided for each cylinder of the engine. The injector 1 shown as an example in FIG. 1 has a fuel injection valve 6, with a closing piston 13 that with its injection openings 9 protrudes into the combustion chamber 5 of a cylinder of an internal combustion engine. The closing piston 13 is surrounded at a pressure shoulder 16 by a pressure chamber 17, which communicates with the high-pressure chamber 28 of the pressure booster device 7 via a high-pressure line 40. The closing piston 13, on its end remote from the combustion chamber, that is, in its guide region 14, protrudes into a closing pressure chamber 12, which can be made to communicate with a chamber 26, communicating with the high-pressure fuel source, of the pressure booster device. A return chamber 27 of the pressure booster device can be made to communicate with the high-pressure fuel source 2 via a fuel line 42, 45 and a 3/2-port directional control valve 8. In a first position, the valve 8 connects the line 42 with the line 45, while a low-pressure line 44 leading to a low-pressure system, not shown in detail, is closed on its end connected to the valve 8. In a second position of the valve, the line 42 leading to the return chamber 27 communicates with the low-pressure line 44, while the end of the line 45 remote from the high-pressure fuel source 2 and connected to the valve is sealed off. The closing piston is resiliently supported via a restoring spring 11, disposed in the closing pressure chamber and tensed between the housing 10 of the injection valve 6 and the closing piston 13; the restoring spring presses the needle region 15 of the closing piston against the injection openings 9. The pressure booster device 7 has a resiliently supported pressure booster piston 21, which disconnects the high-pressure chamber 28 that communicates with the high-pressure line 40 from a chamber 26 which is connected to the high-pressure fuel source 2 via the line 4. The spring 25 used to support the piston is disposed in the return chamber 27 of the pressure booster device. The piston 21 is embodied in two parts and has a first partial piston 22 and a smaller-diameter second partial piston 23. The housing 20 of the pressure booster device is divided by the partial piston 22, disposed displaceably in the housing, into two regions which are disconnected in fluid-tight fashion from one another except for leakage losses. One region is the chamber 26 that communicates with the high-pressure source; the second region has a stepped taper. It includes the second partial piston 23, which plunges displaceably into the taper and demarcates it in fluid-tight fashion from the rest of the second region, which latter forms the return chamber 27. The region defined by the partial piston 23 in the taper forms the high-pressure chamber 28 of the pressure booster device, which chamber communicates with the pressure chamber 17 of the injection valve and communicates via a check valve 29 and a fuel line 49 with the line 47, or the closing pressure chamber 12. The two partial pistons are separate components but can also be embodied as joined solidly to one another. The second partial piston 23, on its end toward the first partial piston, has a spring retainer 24 protruding beyond its diameter, so that the restoring spring 25 tensed against the housing 20 presses the second partial piston against the first partial piston.

The pressure of the high-pressure fuel source 2 is carried to the injector via the line 4. In the first position of the valve 8, the injection valve is not triggered, and no injection occurs. The rail pressure then prevails in the chamber 26, at the valve 8, in the return chamber 27 via the valve 8 and the line 42, in the closing pressure chamber 12, and in both the high-pressure chamber 28 and the pressure chamber 17 via the line 49 that includes the check valve 29. Thus all the pressure chambers of the pressure booster device are subjected to rail pressure, and the pressure booster piston is pressure-equalized; that is, the pressure booster device is deactivated, and no pressure boost takes place. In this state, the pressure booster piston is restored to its outset position via a restoring spring. The high-pressure chamber 28 is filled with fuel via the check valve 29. Because of the rail pressure in the closing pressure chamber 12, a hydraulic closing force is brought to bear on the closing piston. In addition, the restoring spring 11 furnishes a closing spring force. The rail pressure can therefore prevail constantly in the pressure chamber 17, without unwanted opening of the injection valve. Not until the pressure in the nozzle chamber rises above the rail pressure, which is achieved by turning on the pressure booster, does the nozzle needle open and the injection begin. The metering of the fuel into the combustion chamber 5 is effected by activation of the 3/2-port directional control valve 8, or in other words by switching the valve to its second position. As a result, the return chamber 27 is disconnected from the high-pressure fuel source and made to communicate with the return line 44, and the pressure in the return chamber drops. This activates the pressure booster device; the two-part piston compresses the fuel in the high-pressure chamber 28, so that in the pressure chamber 17 that communicates with the high-pressure chamber, the pressure force acting in the opening direction rises, and the closing piston uncovers the injection openings. As long as the return chamber 27 is pressure-relieved, the pressure booster device remains activated and compresses the fuel in the high-pressure chamber 28. The compressed fuel is carried onward to the injection openings and injected into the combustion chamber. For terminating the injection, the valve 8 is returned to its first position again. This disconnects the return chamber 27 from the return line 44 and connects it again to the supply pressure of the high-pressure fuel source, that is, to the high-pressure rail of the common rail system. As a result, the pressure in the high-pressure chamber drops to rail pressure, and since rail pressure again prevails in the pressure chamber 17 as well, the closing piston is hydraulically balanced and is closed by the force of the spring 11, as a result of which the injection event is ended. After a pressure equalization of the system, the pressure booster piston is returned by a restoring spring to its outset position, and the high-pressure chamber 28 is filled from the high-pressure fuel source via the check valve 29 and the line 49. The throttle 3 and the check valve 19 serve, with the parallel-connected throttle 18, to damp oscillations between the high-pressure fuel source and the injector that would otherwise impair the needle closure, and in particular any multiple injections that might have to be performed, that is, closing and opening events in rapid succession.

In an alternative version, the check valve 29 can also be integrated with the pressure booster piston. Both in the alternative integrated design and in the separate design shown in the drawings, the check valve 29 can communicate with the return chamber 27 instead of with the closing pressure chamber 12, so that the filling of the high-pressure chamber upon closure of the injection valve takes place from the return chamber 27 instead of from the closing pressure chamber 12. The throttles 3 and 18 (the latter having a parallel-connected check valve) serving the purpose of damping oscillation can be mounted at any arbitrary point between the high-pressure fuel source and the chamber 26 of the pressure booster. Still other pressure booster devices that are controllable via a return chamber can also be used, such as those with a two-part pressure booster piston, in which the check valve required for filling the high-pressure chamber is integrated with the second (smaller-diameter) partial piston.

Figure 2:
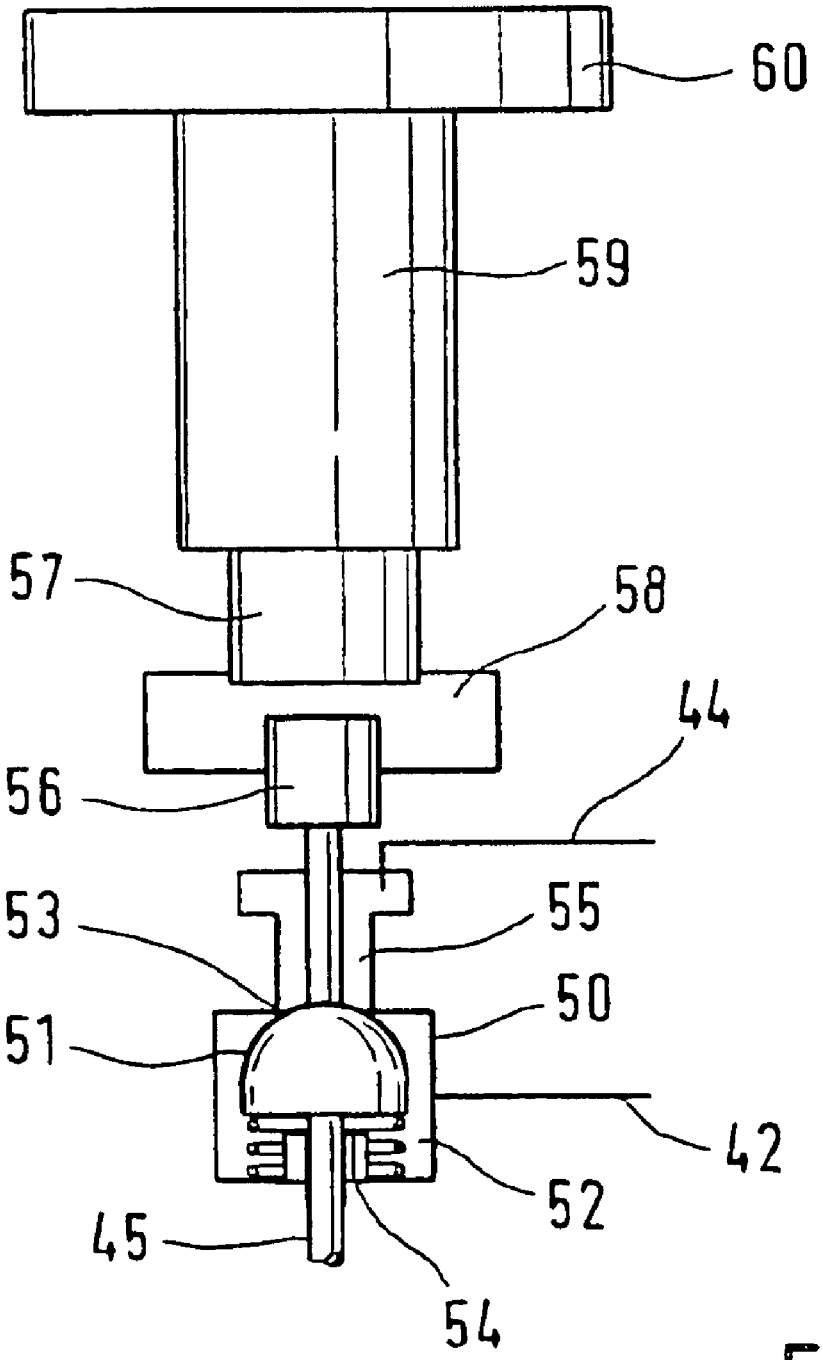
FIG. 2 shows a piezoelectric valve used in the invention.
Figure 3:
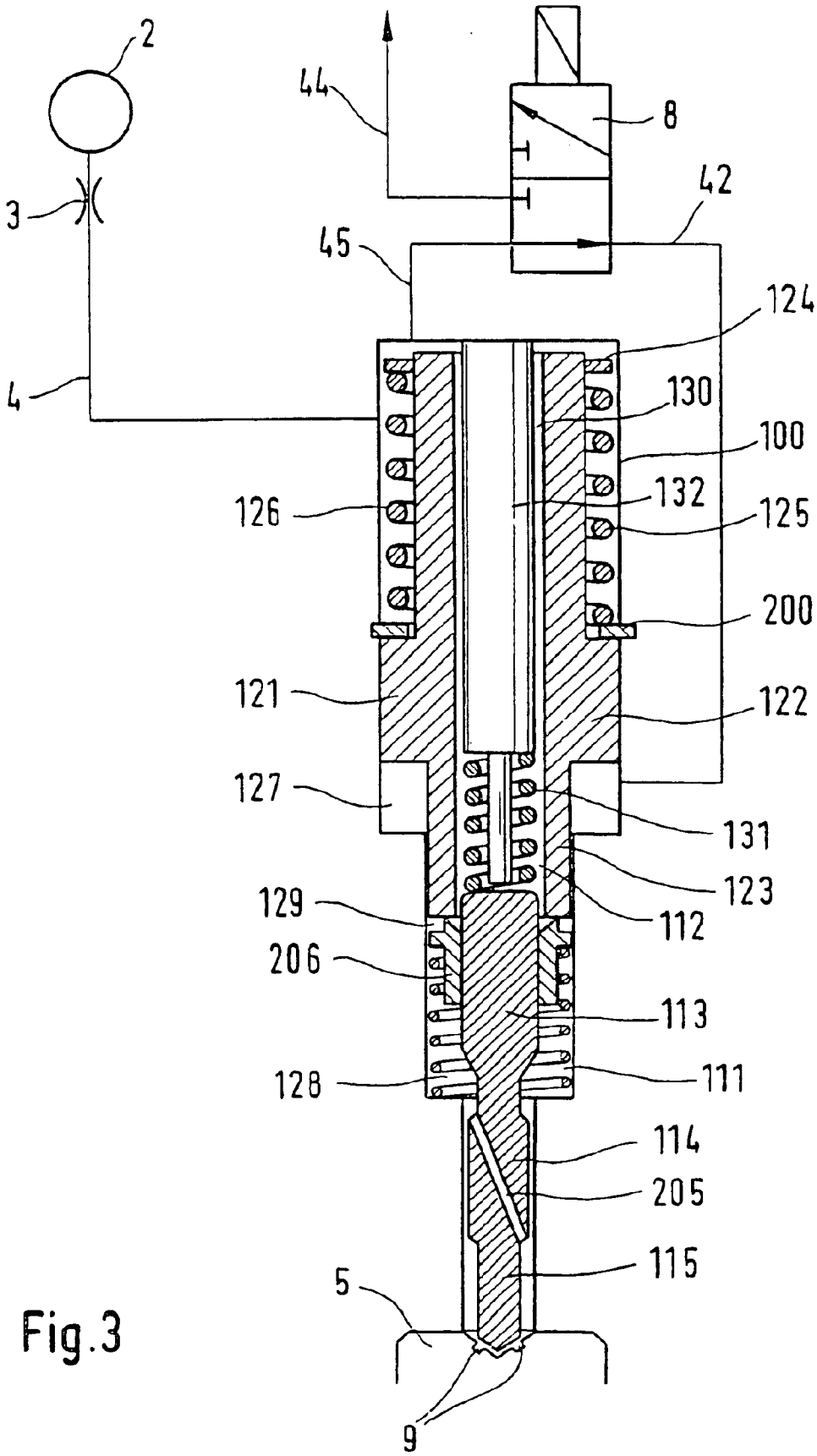
FIG. 3 shows a second embodiment of the fuel injection system.

The 3/2-port directional control valve 8 included in the arrangements of FIGS. 1 and 3 can be embodied as either a magnetically or a piezoelectrically triggerable valve as in FIG. 2. In the piezoelectric version as a 3/2-port directional control valve of FIG. 2, a valve housing 50 communicates with the three connecting lines 42, 44 and 45 known from FIGS. 1 and 3. In the valve housing there is a movably supported valve body 51, which in the position of repose shown is pressed via a restoring spring 52, which is tensed between it and the valve housing, with its hemispherical side face against the first valve seat 53 in a fluid-sealing manner. The opposed side of the valve body, which is formed by a flat face, faces the second valve seat 54 that communicates with the line 45. In the position of repose shown, there is an interstice between the valve body and the second valve seat. A tube 55 leads away from the first valve seat 53, and the low-pressure line 44 is connected to its end remote from the valve body. A first force-transmitting piston 56 rests on the hemispherical side face of the valve body that seals off the tube and protrudes outward from the tube through a sealed-off opening in the side wall of the tube remote from the valve body, so that a force can be exerted on the valve body from outside the valve housing by displacement of the force-transmitting piston. A widened end piece of the piston 56 protrudes into a schematically illustrated coupling chamber 58 that is filled with coupler fluid, such as fuel. This fuel used as coupler fluid originates in a low-pressure system, for example, and from there it is delivered to a line not shown in detail. On the opposite side of the coupling chamber, a second force-transmitting piston 57 protrudes into the coupling chamber. This latter piston is secured to an electrically triggerable piezoelectric actuator 59, which can change its length when an electrical voltage is applied; a bottom element 60 secured to the opposite side of the piezoelectric actuator is spaced apart by the same distance from the coupling chamber in every electrical state of the piezoelectric actuator.

The position shown for the valve body is the first position of the 3/2-port directional control valve. In this state, the valve body closes the communication of the tube with the chamber in which the valve body is movably supported, so that the line 42 can exchange fuel only with the line 45. If the valve is to be switched into its second position, for the sake of performing a metering of fuel into the combustion chamber, then the piezoelectric actuator 59 must be triggered electrically. To compensate for temperature-dictated changes in length of the piezoelectric actuator and, given a suitable embodiment of the only schematically shown coupling chamber 58, to boost the force/travel as well, the piezoelectric actuator is in contact with the force-transmitting piston 56 via the force-transmitting piston 57 and the coupling chamber 58. If the piezoelectric actuator is triggered, it lengthens, and through the coupling chamber a force is transmitted to the valve body that lifts it from the first valve seat and presses it against the second valve seat, so that now instead of the line 45, it is the line 44 that communicates with the line 42.

The piezoelectric valve can communicate, as shown in FIGS. 1 and 3, with the line 4 by means of the line 45. Alternatively, instead of communicating with the line 4, the valve can also communicate directly with the chamber 26. The valve body can take still other forms as well; that is, piezoelectrically actuatable slide valves, flat seat valves or conical seat valves, or an arbitrary combination of these, can be used. If middle positions between the first and second positions are provided, for instance in order to relieve the return chamber only slowly and correspondingly slowly build up the fuel pressure in the high-pressure chamber, it can be advantageous to use, as the switching valve, a valve that does not have any opening overlap of the two valve seats; that is, the second valve seat is for instance closed first, before the first valve seat slowly opens. As a result, with slow valve switching in the transitional region, a lost quantity of fuel is avoided, since at no time is there communication between the rail and the return system. To that end, a seat-slide valve can be used. The piezoelectric valve can also be embodied as a 3/3-port directional control valve; via a suitable electrical triggering of the piezoelectric actuator, alternatively to or in combination with a slow triggering, at least one middle position of the valve body is provided, which exists for a certain length of time, so that preinjections at a constant, low pressure level can for instance be realized. However, in the at least one middle position, this requires a communication of the line 42 with both the line 45 and the line 44, so that a constant intermediate pressure level can develop in both the return chamber and the high-pressure chamber. The intermediate pressure level in the return chamber is defined by the flow cross sections of the valve seats 53 and 54. It is advantageous here to make the cross-sectional areas of the valve seats larger than the cross-sectional areas of the supply line 45 and tube 55, and to select them such that the intermediate pressure level is determined only by the corresponding inlet and outlet flow cross sections of the supply lines 42, 44 and 45. The result in the middle position is a stroke range of the valve body that has no influence on the valve of the intermediate pressure level. Thus possible variations in the stroke of the piezoelectric actuator remain without influence on the injection event.

FIG. 3 shows a further version, with a pressure booster device integrated with the injector housing 100. Components identical to those shown in FIG. 1 are provided with the same reference numerals and will not be described again. In the injector housing, three parts movable relative to one another are supported resiliently: a pressure booster piston 121, a closing piston 113, and a hollow valve piston 206. The pressure booster piston 121 has a first partial piston 122 and a second partial piston 123. The first partial piston 122 is guided axially by the injector housing in a fluid-tight fashion, except for leakage losses. On one side, the first partial piston has a stepped taper, so that there is space between the injector housing and the first partial piston for the restoring spring 125 of the pressure booster device. The restoring spring 125 is fastened between a spring retainer 124, disposed at the taper, and a limiting element 200 secured to the injector housing; the side of the limiting element remote from the restoring spring acts as a stop for the pressure booster piston, to prevent the taper of the first partial piston from striking the injector housing. The chamber 126 between the first partial piston and the injector housing in which the restoring spring 125 is located corresponds to the chamber 26 of FIG. 1 and like it communicates with the high-pressure fuel source 2 via the line 4. The first partial piston 122, on the side remote from the chamber 126, changes over into the smaller-diameter second partial piston 123, which in some regions is also guided by the injector housing, since this housing has a stepped taper in the region of the second partial piston. The space between the second partial piston and the injector housing forms the return chamber 127 of the pressure booster device. The pressure booster piston is embodied as a hollow piston: A central open bore 130 in the pressure booster piston connects the chamber 126 hydraulically with the end of the closing piston 113 that protrudes into the end of the bore remote from the chamber 126, which bore thus acts as the closing pressure chamber 112. The opposite end of the closing piston, that is, the needle region 115, closes the injection openings 9. The guide region 114 of the closing piston, which assures axial guidance of the closing piston along the injector housing that correspondingly has a second stepped taper in the region of the closing piston, is located between the region of the closing piston that protrudes into the closing pressure chamber and the needle region. The guide region is larger in diameter than the needle region. The guide region is penetrated by a connection 205, for instance in the form of a continuous bore, so that the interstice between the needle region and the injector housing and the smaller-diameter region of the closing piston that adjoins the guide region on the far side of the needle region can exchange fuel with one another. A restoring spring 131 presses the closing piston against the injection openings. The hollow valve piston has one end that tapers to a point forming a circular sealing edge and that is pressed by the restoring spring 111 against the face end of the second partial piston, so that the high-pressure chamber 128, which is formed by the space located on the far side of the hollow valve piston between the closing piston and the injector housing, can be sealed off from the closing pressure chamber 112; that is, the hollow valve piston together with the face end of the second partial piston can act as a check valve 129. Between the region protruding in to the bore 130 and the end toward the injection openings of the needle region, the closing piston has two regions with a diameter that is less than the diameter in the portion protruding into the closing pressure chamber; these are first, a waist between the guide region and the region protruding into the bore, and second, the region between the guide region and the end of the closing piston toward the injection openings. A spacer element 132 protruding in the form of a cylinder into the bore 130 is secured to the injector housing 100 in the region of the chamber 126. On the side toward the closing piston, the spacer element 132 has a taper, onto which a closing chamber spring 131 is slipped that presses against the end of the closing piston that protrudes into the bore 130; there is enough free space between the closing piston and the spacer element to make it possible to initiate an injection event by lifting the closing piston from the injection openings. Given suitable dimensioning, the spacer element limits the stroke of the closing piston to the amount required for one injection event.

In the arrangement of FIG. 3, the high-pressure chamber 28 and the pressure chamber 17 of the arrangement of FIG. 1 coincide and are formed by the high-pressure chamber 128. Otherwise, the mode of operation is similar to that of the arrangement of FIG. 1. The check valve for filling the high-pressure chamber 128 is formed by the above-described check valve 129. The metering of the fuel into the combustion chamber 5 is again effected by activation of the 3/2-way control valve 8. As a result, the return chamber 127 and the closing pressure chamber 112 are pressure-relieved and the pressure booster is activated. The fuel in the high-pressure chamber 128 is compressed and carried on to the tip of the injector via the connection 205. Finally, because of the rising opening pressure force in the high-pressure chamber, the closing piston uncovers the injection openings, and the fuel is injected into the combustion chamber. Thus from the outset, the injection pressure is higher than the rail pressure. In this situation, the hollow valve piston 206 seals the high-pressure chamber 128 off from the closing piston with a guide; the hollow valve piston is axially displaceable and during the compression of the fuel in the high-pressure chamber moves together with the pressure booster piston toward the injection openings. As already explained, with its sealing seat, the hollow valve piston also seals off the high-pressure chamber from the second partial piston. This assures that compressed fuel cannot flow back into the closing pressure chamber. For terminating the injection, the return chamber 127 is disconnected from the line 44 by the control valve 8 and made to communicate with the high-pressure fuel source 2, as a result of which the rail pressure builds up in the return chamber and in the closing pressure chamber, and the pressure in the high-pressure chamber drops to the rail pressure. The closing piston is now hydraulically balanced and is closed by the force of the closing chamber spring 131, which ends the injection event. As a consequence of the pressure equalization, the pressure booster piston 121 is now also returned to its outset position by the restoring spring 125, and the high-pressure chamber 128 is filled via the check valve 129 from the closing pressure chamber 112, which in turn is supplied with fuel from the chamber 126.

For stabilizing the switching sequences, additional structural provisions can be made for damping any fluctuations that may occur between the high-pressure fuel source and the injector. Besides a suitable design of the throttle 3, it is also possible alternatively or in combination to install throttle check valves at an arbitrary point in the supply lines 4, 42 and 45. Moreover, the pressure booster piston, closing piston and hollow valve piston can also have shapes that differ from those described. What is essential in the closing piston is only that first, fuel delivery as far as the injection openings is assured and that second, in the region of the high-pressure chamber, the fuel pressure finds an engagement face that effectively leads to an axial force on the closing piston that is oriented toward the pressure booster piston, or in other words that acts in the opening direction.

Figure 4:
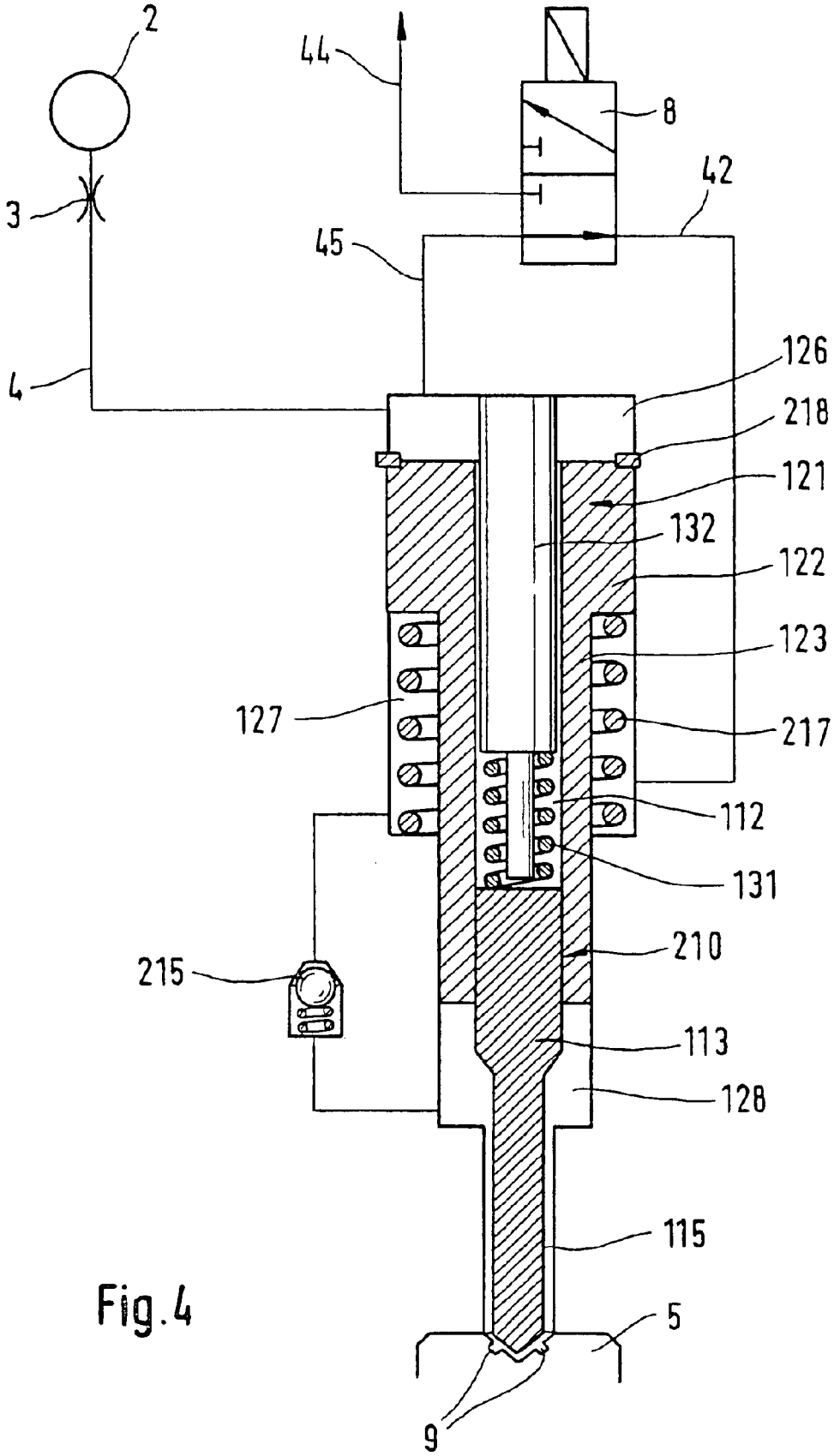
FIG. 4 shows a further embodiment of the fuel injection system.

FIG. 4 illustrates a further design of an injector with an integrated pressure booster device. Unlike the arrangement of FIG. 3, the closing piston 113 is guided in fluid-tight fashion except for leakage losses by the guide region 210 of the second partial piston 123. The hollow valve piston 206 of FIG. 3 can therefore be omitted; instead, a separate check valve 215 for filling the high-pressure chamber 128 must be provided, which in the example shown communicates with the return chamber 127. As in the arrangement of FIG. 1 or FIG. 3, the chamber 126 and the closing pressure chamber 112 can exchange fuel with one another constantly, but unlike the arrangement of FIG. 3, the spring 217 that restores the pressure booster piston is accommodated not in the chamber 126 but rather in the return chamber 127, where it is fastened between a stepped constriction of the injector housing and the first partial piston 122. A limiting element 218 secured to the injector housing here limits the freedom of motion of the pressure booster piston, so that the chamber 126 always has a value other than zero.

In alternative versions, the check valve 215 can communicate with the chamber 126 or directly with the line 4, instead of communicating with the return chamber 127. The check valve can also be integrated with the pressure booster piston 121 or with the closing piston 113.

In all the exemplary embodiments, the closing pressure chamber 12 and 112 and the chamber 26 and 126 are realized by a common closing pressure work chamber (12, 26, 47) and (112, 126, 130); all the portions (12, 26) and (112, 125), respectively, of the closing pressure work chamber communicate permanently with one another for exchanging fuel, for instance via at least one fuel line 47 or via at least one bore 130 integrated with the pressure booster piston. The pressure chamber 17 and the high-pressure chamber 28 can moreover be formed by a common injection chamber (17, 28, 40), and all the portions of the injection chamber communicate with one another permanently for exchanging fuel. The pressure chamber 17 and the high-pressure chamber 28 may communicate with one another via a fuel line 40 (see FIG. 1), or the pressure chamber can be formed by the high-pressure chamber (128) itself (see FIGS. 3 and 4).

Figure 5:
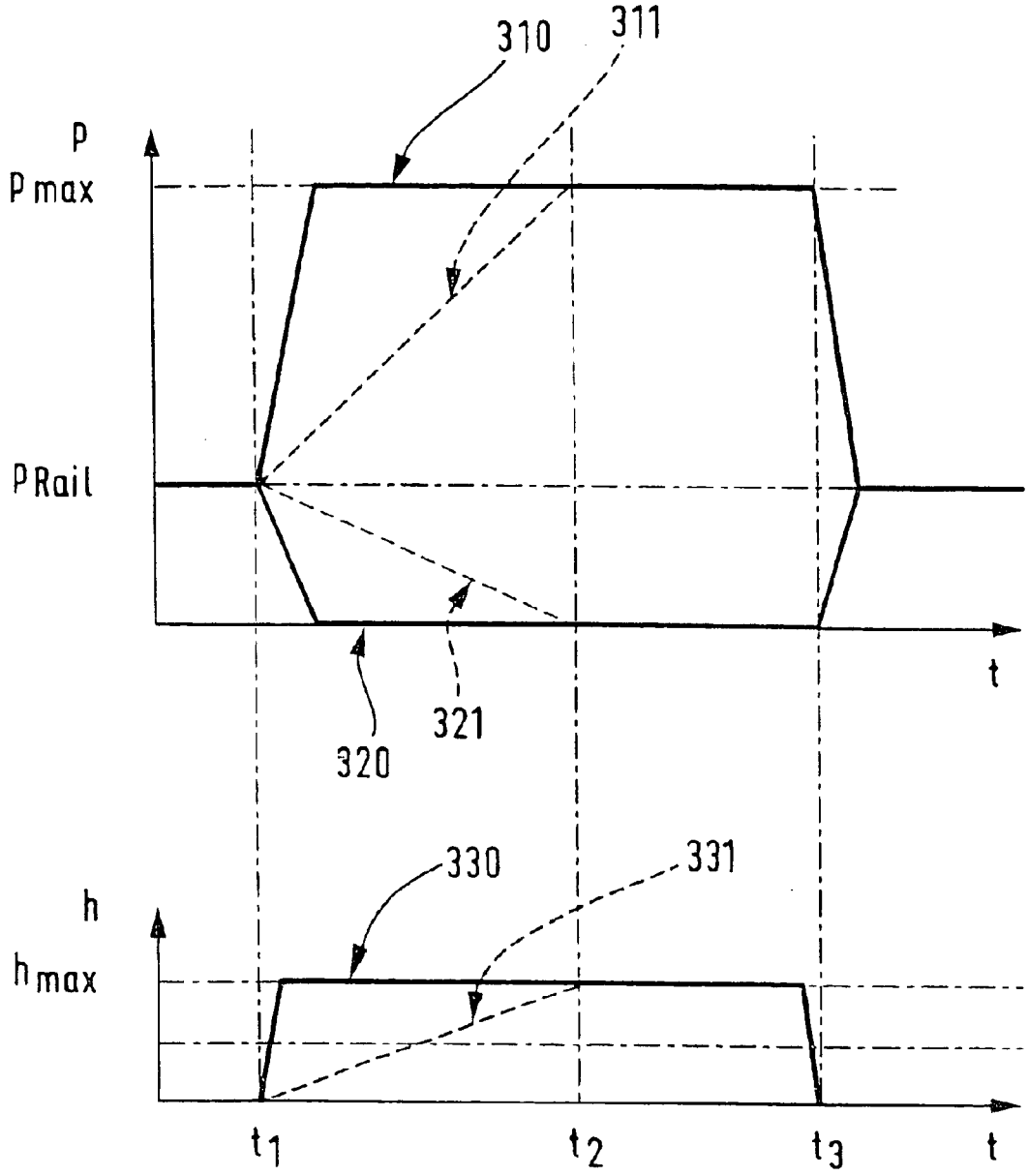
FIG. 5 shows two graphs of pressure ratios for various switching speeds.

FIG. 5 shows the courses over time of the fuel pressure p in the high-pressure chamber 28 and 128. The curve 310 represents the pressure ratios upon fast actuation of the 3/2-port piezoelectric valve of FIG. 2, while the curve 311 shows it in the case of slow valve actuation. The first position of the valve, in which the valve body is pressed against the first valve seat 53, will hereinafter be called the position of repose, and the second position, in which the valve body is pressed against the second valve seat 54, will be called the terminal position. In the case of fast valve actuation, the piezoelectric valve is triggered electrically in such a way that the valve body rapidly moves from the position of repose to the terminal position, while in the case of slow valve actuation, the electrical voltage applied to the piezoelectric actuator is increased slowly, so that the valve body moves from the position of repose to the terminal position at a low speed. The curves 320 and 321 show the associated pressure courses in the return chamber of the pressure booster as a function of the time t. The resultant stroke h of the piezoelectric actuator, that is, the motion of the valve body, is plotted in curves 330 and 331. The symbol $p_{Rail}$ designates the pressure of the high-pressure fuel source, that is, the pressure in the high-pressure rail of the common rail system; $p_{max}$ is the maximum fuel pressure attainable in the high-pressure chamber; and $h_{max}$ is the maximum stroke of the valve body.

In the position of repose of the valve body, the pressure booster is deactivated, and the piston of the pressure booster is returned to its outset position; no injection takes place. Both in the high-pressure chamber and in the return chamber, rail pressure $P_{Rail}$ prevails (see the curves 310, 311, 320 and 321 in the time period from zero to time $t_1$). In the terminal position $h_{max}$ of the valve body, the pressure booster is fully activated; the pressure in the return chamber drops to a low value near zero, and the pressure in the high-pressure chamber reaches its maximum value $p_{max}$. The closing piston is lifted, and an injection takes place. In a transitional region between the position of repose and the terminal position, the pressure booster here is partly activated; the pressure in the return chamber decreases with an increasing stroke of the piezoelectric valve, and the pressure booster piston generates a medium injection pressure, which rises with an increasing valve stroke, so that the injection proceeds with a rising pressure. In the graphs shown in FIG. 5, for the sake of simplification, it is assumed that the nozzle opening pressure differs only insignificantly from the rail pressure. Upon slow actuation of the valve from time $t_1$ (curve 331) on, the pressure in the return chamber drops continuously until time $t_2$ to a low value (curve 321), while in the pressure in the high-pressure chamber rises slowly (curve 311) to the value $p_{max}$. When the nozzle opening pressure is reached shortly after $t_1$, the closing piston lifts from the injection openings and opens completely, so that with increasing pressure an increasing quantity of fuel is injected. At time $t_2$, the maximum opening stroke $h_{max}$ of the valve body and the maximum injection pressure $p_{max}$ are attained. The closing event at time $t_3$ is fast, in order to assure a fast pressure reduction at the end of injection (the professional term for this in English is "rapid spill"). Thus at time $t_3$, when the lengthening of the piezoelectric actuator is reversed, the pressure in both the high-pressure chamber and the return chamber is returned to the rail pressure level, and the closing piston closes the injection openings again. If conversely at time $t_1$ the valve is triggered quickly (curve 330), then the transitional region is rapidly traversed, and the pressure in the high-pressure chamber rises to the maximum level $p_{max}$ (see curve 310) considerably earlier than time $t_2$, while at the same time the pressure in the return chamber rapidly drops to a lower value (see curve 320). Accordingly, a quasi-rectangular pressure course 310 results. The closing event is preferably fast, analogously to the case described above, in order to assure a fast pressure reduction at the end of injection.

Figure 6:
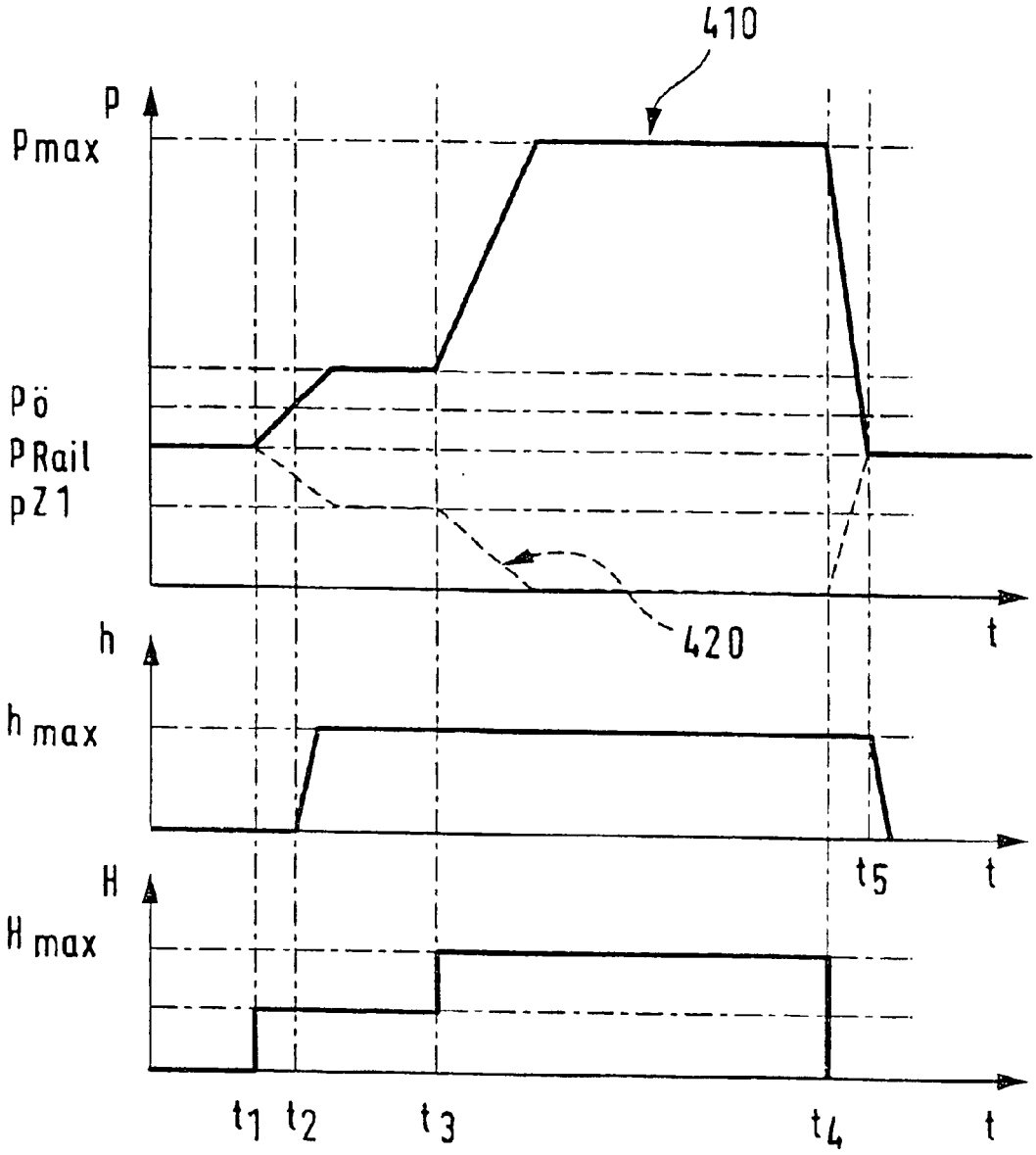
FIG. 6 shows three graphs illustrating the switching states of the valve.

FIG. 6 shows the pressure ratios for the case where the piezoelectric valve of FIG. 2 is operated as a 3/3-port directional control valve, for instance. Besides the position of repose and the terminal position, the valve body of this valve also has a middle position, in which it can remain for at least a certain length of time, and in which the line 42 communicates with both the line 45 and the line 44. Then in this period of time a pressure equilibrium at an intermediate pressure level PZ1 can be established in the return chamber; this level is determined by the outflowing quantity into the low-pressure system and the inflowing quantity from the high-pressure fuel source, taken together. The curve 410 shows the pressure course in the high-pressure chamber, and the curve 420 shows the pressure course in the return chamber. In the h(t) graph shown below, the course over time of the stroke of the closing piston is shown, while in the third graph, the course over time of the piezoelectric stroke H, that is, the motion of the valve body, is plotted. The symbol $H_{max}$ designates the maximum value for the piezoelectric stroke, with which the terminal position of the valve body in which the return chamber now communicates with only the low-pressure system can be established. The opening pressure $p_{\ddot{o}}$ in the high-pressure chamber is the pressure required to lift the closing piston. The symbols $t_1$ through $t_5$ designate various successive instants within an injection cycle that includes a boot injection, that is, a first injection phase at a low pressure level, and a second injection phase at a high pressure level.

At time $t_1$, the valve body is switched to the middle position by a suitable triggering of the piezoelectric actuator and is kept in this middle position until time $t_3$ (see the H(t) graph). In the return chamber, the pressure drops to the intermediate pressure level PZ1, while the pressure in the high-pressure chamber slowly rises. As soon as it exceeds the opening pressure at time $t_2$, the injector opens (see the h(t) graph), and a boot injection phase takes place at a pressure level between the rail pressure level and the maximum pressure value attainable with the pressure booster. At time $t_3$, the piezoelectric valve is switched into its terminal position (second position) with the stroke value $H_{max}$, so that the pressure in the return chamber drops to a lesser value near zero, while the injection openings continue to remain open and the pressure in the high-pressure chamber rises to the value $p_{max}$. This main injection phase lasts until time $t_4$, when the valve is returned to its position of repose (H=0), so that in the high-pressure chamber and in the return chamber a pressure equalization to the rail pressure level takes place, and a short time later, at time $t_5$, the closing piston closes the injection openings (h=0).

Alternatively, the intermediate position can also be used for an injection at low injection pressure, again proceeding from the intermediate position to the position of repose. This is done for instance when there are small injection quantities involved, of the kind required in a preinjection or during idling.

In all the exemplary embodiments, the closing pressure chamber 12 and 112 and the chamber 26 and 126 are realized by a common closing pressure work chamber (12, 47, 26) and (112, 130, 126); all the portions (12, 26) and (112, 125), respectively, of the closing pressure work chamber communicate permanently with one another for exchanging fuel, for instance via at least one fuel line 47 or via at least one bore 130 integrated with the pressure booster piston. The pressure chamber 17 and the high-pressure chamber 28 can moreover be formed by a common injection chamber (17, 28, 40), and all the portions of the injection chamber communicate with one another permanently for exchanging fuel. The pressure chamber 17 and the high-pressure chamber 28 may communicate with one another via a fuel line 40 (see FIG. 1), or the pressure chamber can be formed by the high-pressure chamber (128) itself (see FIGS. 3 and 4).

Figure 7:
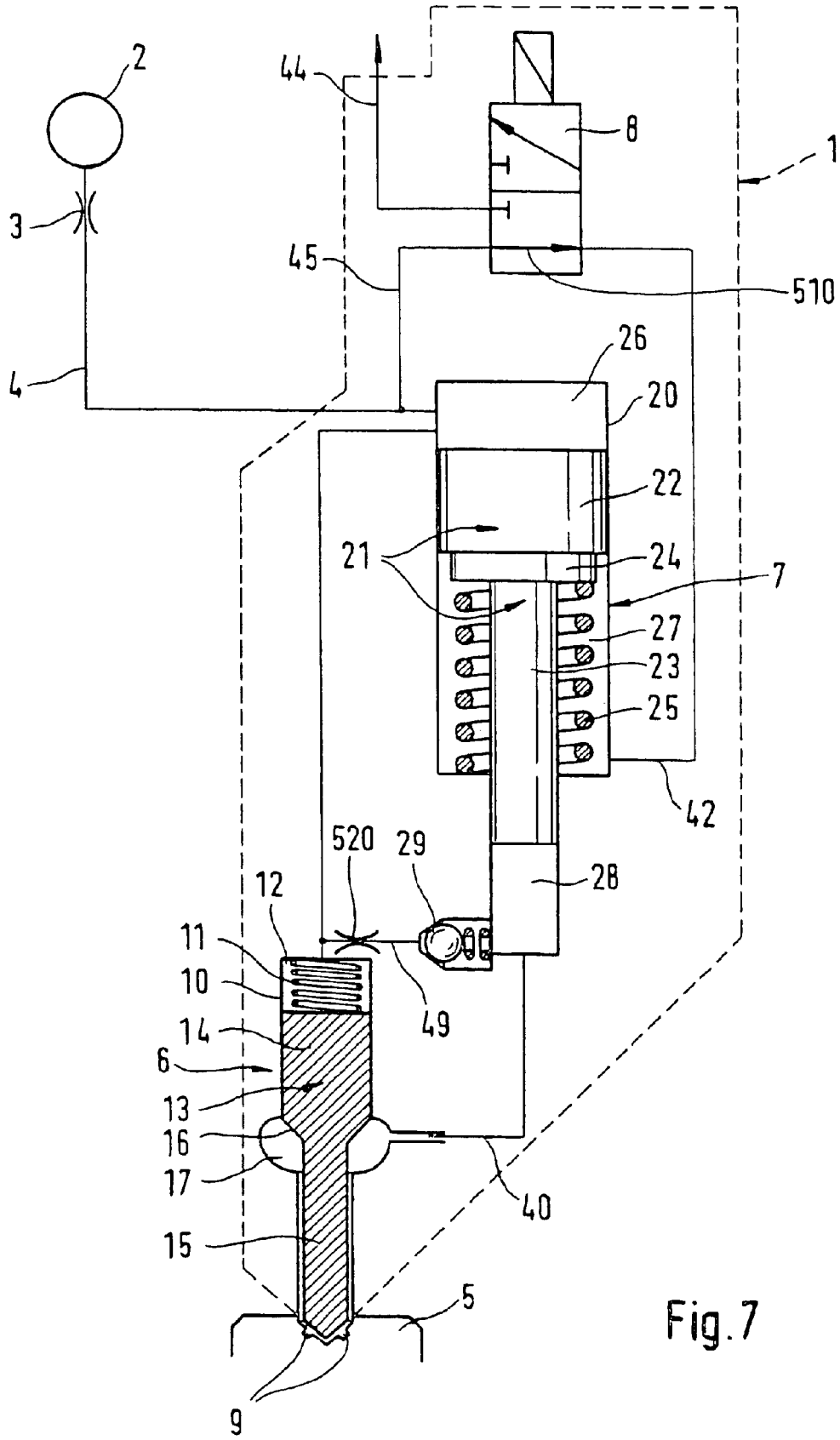
FIG. 7 shows a further alternative embodiment.

FIG. 7 shows a modification of the embodiment of FIG. 1, in which with an otherwise identical design, a throttle 520 is additionally installed in the line 49, so that the communication between the high-pressure chamber 28 and the closing pressure chamber 12 or chamber 26 is throttled. The cross section of the communication path of the 3/2-port directional control valve 8 between the line 45 and the line 42 is identified by reference numeral 510 and will hereinafter be called the valve cross section.

By a suitable adaptation of the valve cross section 510, which connects the return chamber 27 to the pressure supply, and of the flow cross section of the filling path 49 by means of a suitable choice of the flow cross section of the throttle 520, a hydraulic supplementary force for closing the needle can be generated. To that end, by means of the throttle 520, the filling path 49 is designed to be quite small, yet large enough to enable filling of the high-pressure chamber 28 and restoration of the pressure booster piston by the time of the next injection. Moreover, the valve cross section 510 is designed as large enough that a rapid pressure buildup to rail pressure takes place in the return chamber 27; depending on the layout of the lines, an overelevation of pressure can also occur in the return chamber. As a result of the rapid pressure buildup in the return chamber, a rapid pressure drop to rail pressure takes place in the high-pressure chamber 28, with an ensuing underswing of pressure to below rail pressure. The throttle 520 prevents an overly rapid pressure equalization between chamber 28 and chamber 12 or 27. Since in this phase rail pressure continues to prevail in the closing pressure chamber 12, a closing hydraulic force on the nozzle needle occurs.

In a further alternative embodiment, the design of the flow cross section of the filling path 49 is assured not by the use of a throttle but rather by a check valve 29 that has a corresponding flow cross section.

Figure 8:
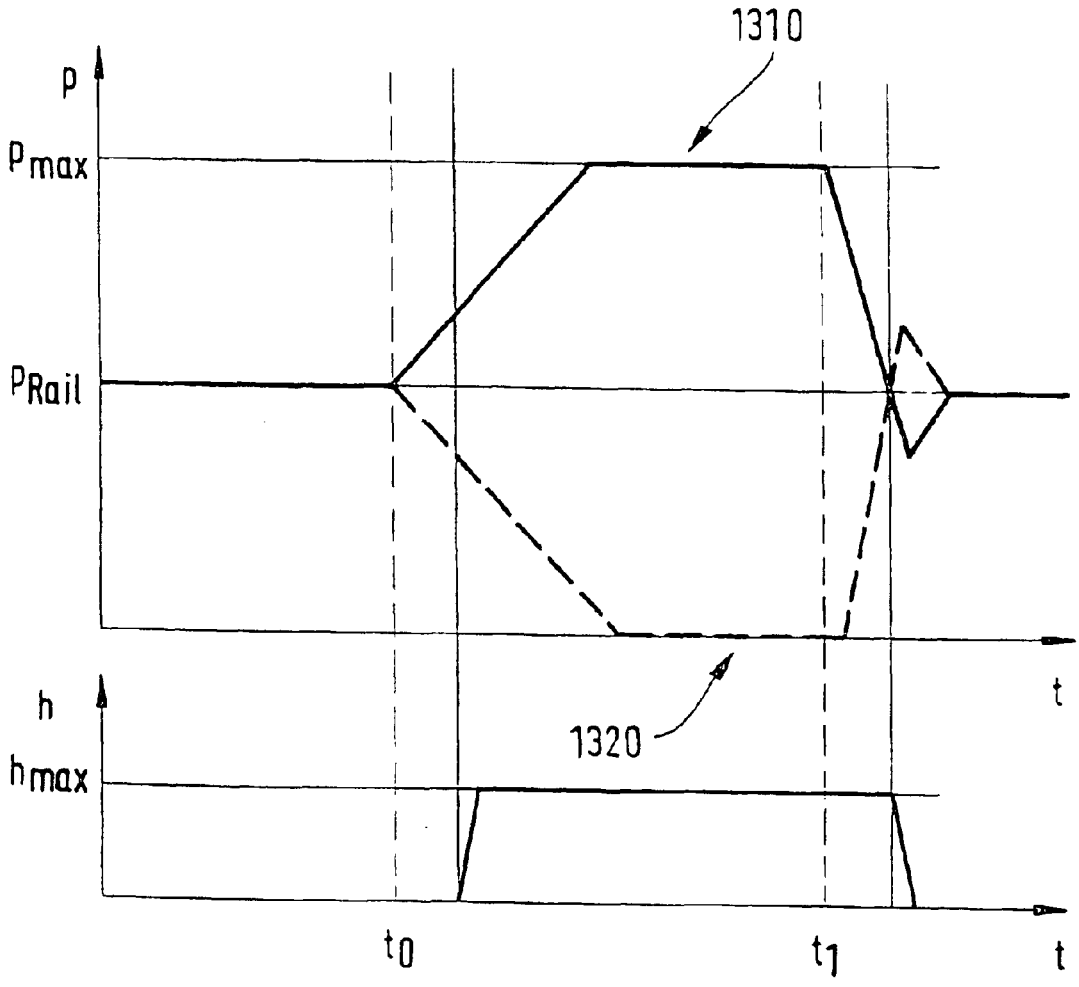
FIG. 8 shows pressure courses pertaining to the arrangement of FIG. 7.

FIG. 8 schematically shows the pressure courses attainable with the arrangement of FIG. 8. Here the course over time of the fuel pressure in the high-pressure chamber 28 is identified by reference numeral 1310; the course over time of the fuel pressure in the return chamber 27 of the pressure booster is identified by reference numeral 1320.

The end of injection is as follows here: After deactivation of the valve 8, a pressure buildup to rail pressure occurs in the return chamber 27 and in the closing pressure chamber 12, and as a result a rapid pressure drop to rail pressure simultaneously occurs in the high-pressure chamber 28 and in the pressure chamber 17. This latter pressure drop takes place so fast that an underswing of the pressure in the high-pressure chamber and in the pressure chamber of the injector to below the rail pressure takes place. Precisely in this phase, the needle closure takes place, so that an additional hydraulic pressure force on the nozzle needle occurs, as a result of which fast needle closure is achieved, and the fuel quantities can be metered even more precisely into the combustion chambers of the engine. As the course continues, the rail pressure is established in the high-pressure chamber and in the pressure chamber as well. The overswing to above the rail pressure shown in the curve 1320 is caused hydraulically and can be minimized or suppressed by means of a suitable layout of lines. What is essential for the fast pressure drop with a subsequent underswing to below rail pressure in the high-pressure chamber is the fast pressure buildup in the return chamber.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for internal combustion engines, having a fuel injector that can be supplied from a high-pressure fuel source, wherein a pressure booster device having a movable pressure booster piston is connected between the fuel injector and the high-pressure fuel source, and the pressure booster piston separates a chamber that is connectable to the high-pressure fuel source from a high-pressure chamber communicating with the fuel injector, and by filling a return chamber of the pressure booster device with fuel and by evacuating the return chamber of fuel, the fuel pressure in the high-pressure chamber can be varied, and the fuel injector has a movable closing piston for opening and closing injection openings, the improvement wherein the movable closing piston (13; 113) protrudes into a closing pressure chamber (12; 112), whereby the closing piston can be subjected to fuel pressure to attain a force acting in the closing direction on the closing piston, and wherein the closing pressure chamber (12; 112) and the chamber (26; 126) are formed by a common work chamber with all the portions (12, 47, 26; 112, 130, 126) of the work chamber communicating (47; 130) permanently with one another for exchanging fuel.

2. The fuel injection system of claim 1, wherein the pressure booster piston is disposed coaxially to the closing piston, and wherein the portion (112) of the work chamber adjoining the closing piston communicates with the other portions of the work chamber via a bore (130) integrated with the pressure booster piston.

3. The fuel injection system of claim 2, wherein the end of the closing piston remote from the injection openings is extended through the bore (130) in fluid-tight fashion except for leakage losses.

4. The fuel injection system of claim 1, wherein the fuel injector comprises a pressure chamber (17; 205, 128) for supplying the injection openings with fuel and for subjecting the closing piston to a force acting in the opening direction.

5. The fuel injection system of claim 4, wherein the pressure chamber (17; 205, 128) and the high-pressure chamber (28; 128) are formed by a common injection chamber (17, 28, 40; 205, 128), and all the portions (17, 28; 205, 128) of the injection chamber communicate with one another permanently for exchanging fuel.

6. The fuel injection system of claim 5, wherein the pressure chamber (17) and the high-pressure chamber (28) communicate with one another via a fuel line (40).

7. The fuel injection system of claim 5, wherein the pressure chamber is formed by the high-pressure chamber (128).

8. The fuel injection system of claim 1, wherein the closing pressure chamber (112) and the return chamber (127) are demarcated from one another by a partial piston (123) of the pressure booster piston (121).

9. The fuel injection system of claim 1, wherein the high-pressure chamber (28; 128) communicates with the closing pressure chamber (12; 112) via a check valve (29; 129).

10. The fuel injection system of claim 9, wherein the communication between the high-pressure chamber and the closing pressure chamber is throttled (520; 29) in such a way that during a closing event, the pressure in the pressure chamber can underswing to below the pressure of the high-pressure fuel source.

11. The fuel injection system of claim 1, wherein the high-pressure chamber (128) communicates with the return chamber (127) via a check valve (215).

12. The fuel injection system of claim 1, wherein the return chamber (27; 127) can be made to communicate via a valve (8) selectively with a low-pressure line (44) or with the high-pressure fuel source (2).

13. The fuel injection system of claim 12, wherein the valve is a piezoelectric valve that has a first and a second position, and the piezoelectric valve connects the return chamber to the high-pressure fuel source, in a first position, and to the low-pressure line (44), in a second position.

14. The fuel injection system of claim 13, wherein the piezoelectric valve is embodied such that the speed of the transition between the first position and the second position can be varied.

15. The fuel injection system of claim 12, wherein the valve can be switched into at least one intermediate position, so that an intermediate pressure level results in the return chamber.

16. The fuel injection system of claim 13, wherein the valve can be switched into at least one intermediate position, so that an intermediate pressure level results in the return chamber.

17. The fuel injection system of claim 14, wherein the valve can be switched into at least one intermediate position, so that an intermediate pressure level results in the return chamber.

18. The fuel injection system of claim 15, wherein the valve in the intermediate position connects the return chamber with both the high-pressure fuel source and the low-pressure line.

19. The fuel injection system of claim 16, wherein the valve in the intermediate position connects the return chamber with both the high-pressure fuel source and the low-pressure line.

20. The fuel injection system of claim 17, wherein the valve in the intermediate position connects the return chamber with both the high-pressure fuel source and the low-pressure line.

* * * * *